US007581265B1

(12) United States Patent
Bourgraf et al.

(10) Patent No.: US 7,581,265 B1
(45) Date of Patent: Sep. 1, 2009

(54) ROLL-IN CHAIR COT WITH THREE COT HEIGHT POSITIONS

(75) Inventors: Elroy E. Bourgraf, Cincinnati, OH (US); Elroy E. Bourgraf, Jr., Maineville, OH (US); Irvin Pollock, Wilmington, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 181 days.

(21) Appl. No.: 11/444,238

(22) Filed: May 31, 2006

Related U.S. Application Data

(60) Provisional application No. 60/687,279, filed on Jun. 3, 2005.

(51) Int. Cl.
*A61G 1/02* (2006.01)

(52) U.S. Cl. ..... 5/618; 5/625; 5/626

(58) Field of Classification Search ..... 5/86.1, 5/611, 618, 625, 626
See application file for complete search history.

(56) References Cited

U.S. PATENT DOCUMENTS

| | | | | |
|---|---|---|---|---|
| 3,122,758 | A | 3/1964 | Ferneau | |
| 3,137,511 | A | 6/1964 | Weil et al. | |
| 3,289,219 | A * | 12/1966 | Ferneau et al. | 5/626 |
| 3,380,085 | A | 4/1968 | Ferneau et al. | |
| 4,105,242 | A | 8/1978 | Terbeek | |
| 4,688,279 | A | 8/1987 | Vance | |
| 4,949,410 | A | 8/1990 | Failor et al. | |
| 5,022,105 | A | 6/1991 | Catoe | |
| 6,381,781 | B1 | 5/2002 | Bourgraf et al. | |
| 7,124,454 | B2 * | 10/2006 | Walkingshaw | 5/86.1 |
| 7,140,055 | B2 * | 11/2006 | Bishop et al. | 5/611 |

* cited by examiner

*Primary Examiner*—Fredrick Conley
(74) *Attorney, Agent, or Firm*—Dinsmore & Shohl LLP

(57) ABSTRACT

A roll-in chair cot which is movable between a chair position, a fully lowered cot height position, a fully elevated cot height position, and an intermediate cot height position is disclosed. With the chair cot positioned in the intermediate position, the chair cot is approximately bed height such that a patient may be laterally transferred from the bed to the chair cot in a generally supine position.

18 Claims, 17 Drawing Sheets

ROLL-IN CHAIR COT WITH THREE COT HEIGHT POSITIONS

CROSS REFERENCE TO RELATED APPLICATION

This application claims the benefit of U.S. Provisional Application No. 60/687,279, filed Jun. 3, 2005, which is incorporated by reference.

BACKGROUND OF THE INVENTION

The present invention relates to ambulance cots used to load patients into the back of an ambulance. More particularly, the present invention relates to a roll-in chair cot with three cot height positions.

In transporting emergency patients from their homes to a hospital for treatment, it is oftentimes necessary to remove the patient from his home using an ambulance cot, wherein the patient is situated thereon in a generally supine position. As well known in the art, such cots are typically provided with an undercarriage having a rollable base which facilitates transportation of the patient situated upon the cot in either a fully elevated or a fully lowered cot height position to an ambulance parked near the patient's home. The undercarriage may be collapsed, thereby permitting the cot, its undercarriage, and the patient situated thereon to be rolled into the back of the ambulance in a fully lowered position for transportation to the hospital.

However, in removing the patient from his home, it is sometimes difficult for paramedics to place the patient on the cot situated in either the fully lowered or the fully elevated cot height position, such as is typical for prior art cots. Additionally, it is often difficult—sometimes impossible—for paramedics to traverse stairs, and narrow hallways and doorways, with the cot in either the fully lowered or the fully elevated cot height position.

SUMMARY OF THE INVENTION

It is against the above background that the present invention provides a number of advancements and improvement over the prior art.

In one embodiment, a roll-in chair cot for transporting a patient is provided. The roll-in cot comprises a patient support surface configured to be movable between a chair position, a fully lowered position, a fully elevated cot height position, and an intermediate cot height position between the fully lowered cot height position and the fully elevated cot height position. The patient support in each of the fully lowered cot height position, a fully elevated cot height position, and an intermediate cot height position is configured to permit the patient to be transported thereon in a generally supine position.

In another embodiment, a roll-in chair cot for transporting a patient is provided. The roll-in cot comprises a patient support surface configured to be movable between a chair position, a fully lowered cot height position, a fully elevated cot height position, and an intermediate cot height position between the fully lowered cot height position and the fully elevated cot height position. The chair position provides the patient support in a manner to permit the patient to be transported upon the chair cot in a generally seated position, and each of the cot height positions provides the patient support in a manner to at least permit the patient to be transported upon the chair cot in a generally supine position. The cot transitions from the fully elevated cot height position to the intermediate cot height position in a first direction, and from the fully elevated cot height position to the fully lowered position in a second direction opposite to the first direction.

These and additional objects, features and advantages of the present invention will become apparent to those reasonably skilled in the art from the description which follows, and may be realized by means of the instrumentalities and combinations particularly pointed out in the claims appended hereto.

BRIEF DESCRIPTION OF THE DRAWINGS

A better understanding of the present invention will be had upon reference to the following description in conjunction with the accompanying drawings in which like reference numerals represent like parts, and wherein.

DETAILED DESCRIPTION OF THE INVENTION

Figure 1A:
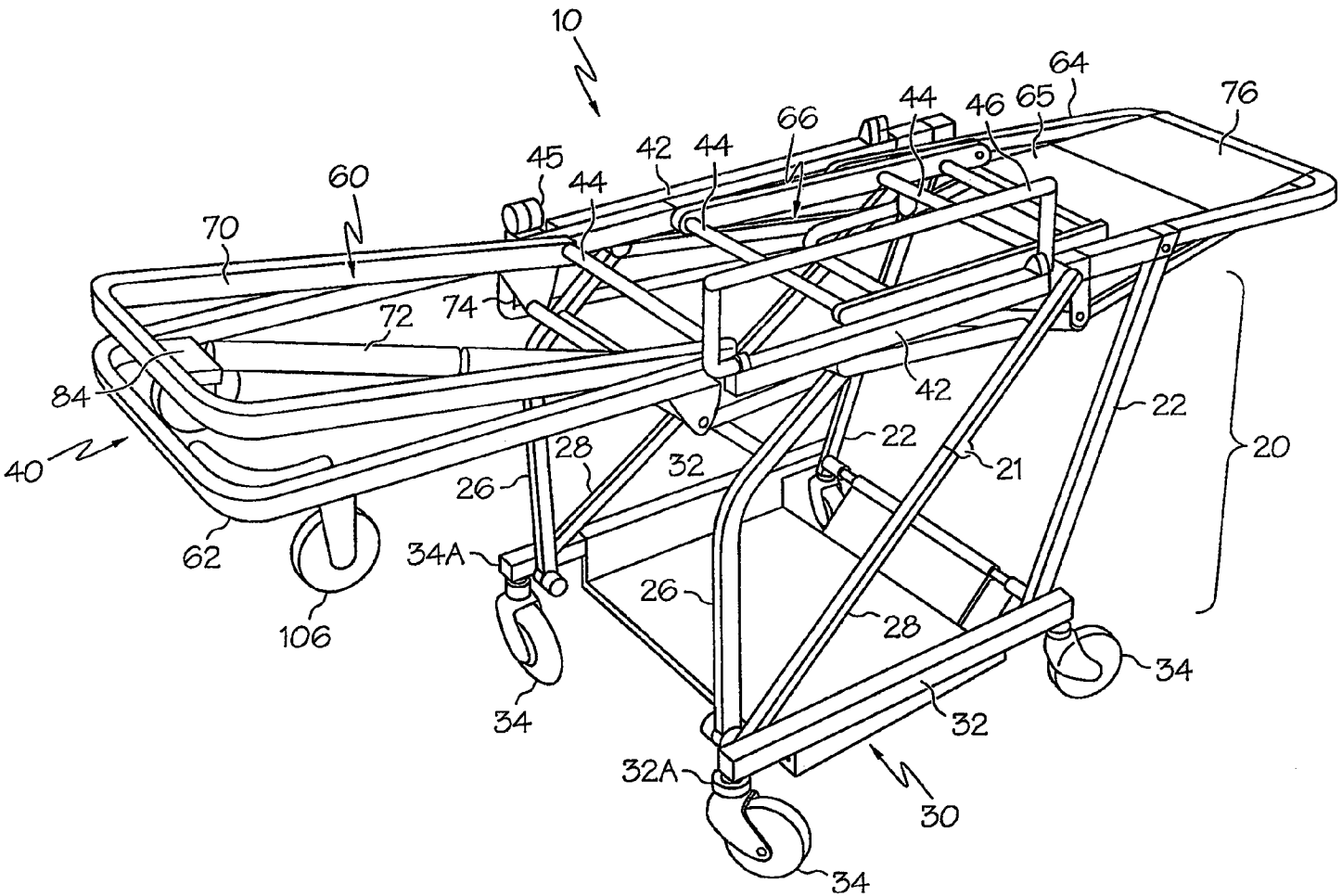
FIGS. 1A and 1B are perspective views of a roll-in chair cot according to an embodiment of the present invention, showing the cot in a cot configuration located at a fully raised cot height position.
Figure 1B:
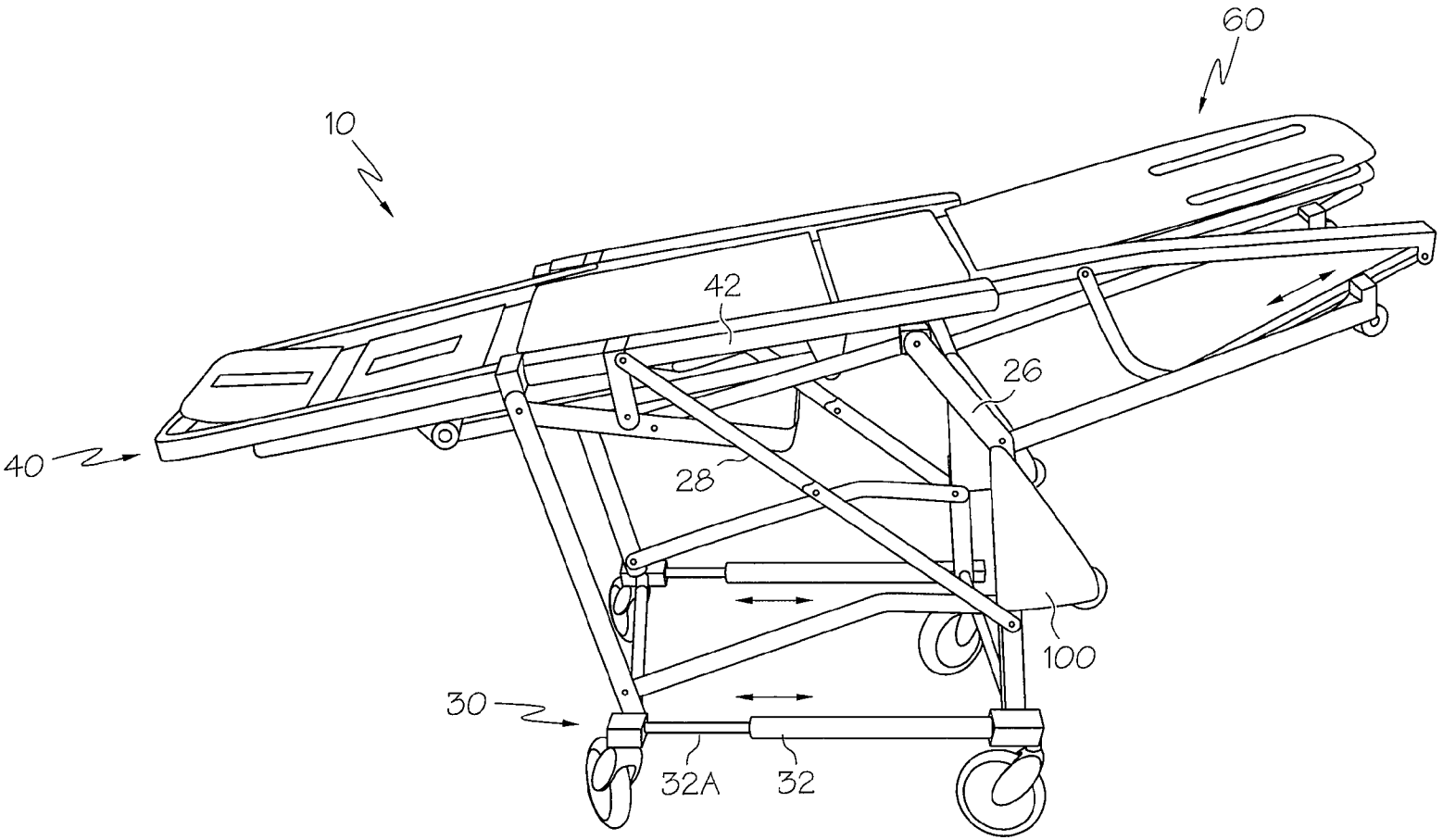

With reference to FIGS. 1A and 1B, a roll-in chair cot 10 according to an embodiment of the present invention is shown. Both sides of the cot 10 are identical, and as such with reference made first to FIG. 1A, only one side of the cot 10 will be described herein. The roll-in chair cot 10 includes a collapsible undercarriage, generally indicated by 20, supportably connecting a roller base 30 to a support frame 40. Roller base 30 includes a generally rectangular frame having members 32, 32A rotatably mounting castor wheels 34 at their respective ends. Each member pair 32, 32A slidably move or telescope relative to each other.

Figure 4A:
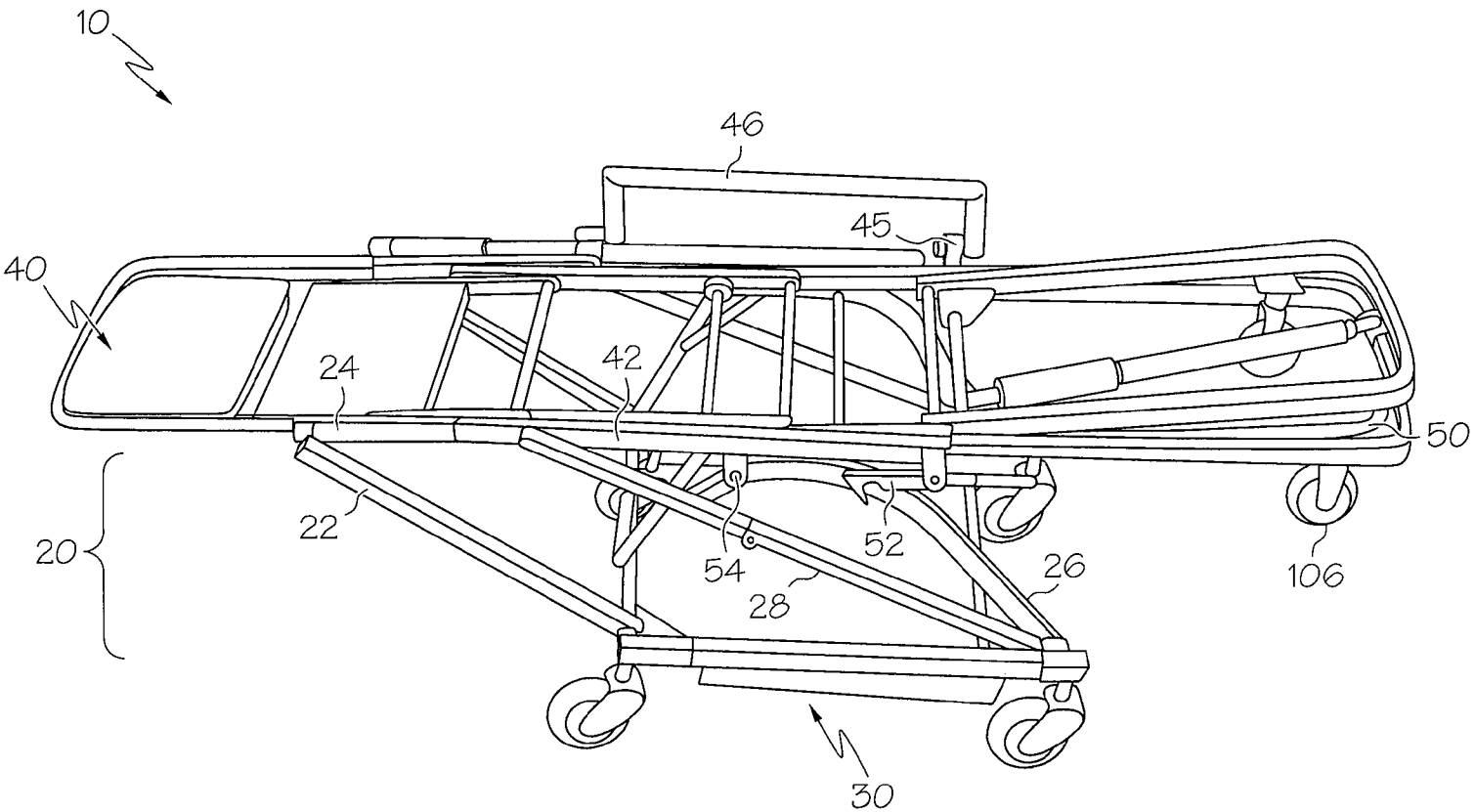
FIGS. 4A and 4B are perspective views of a roll-in chair cot according to an embodiment of the present invention, showing the cot in a cot configuration located at an intermediate cot height position.

The support frame 40 is rectangular in shape with three sides having frame members and a fourth side open to permit patient loading. The support frame 40 is generally comprising a pair of telescoping members 42 and cross members 44. Each of the pair of telescoping members 42 include a swing-down side hand rail 46 which are pivotably connected thereto. Each side hand rail 46 is moveable between an upward position, such as is shown in FIG. 1A, a downward position, and a horizontal position. A locking mechanism 45, best shown in FIG. 4A, is adapted to releasably lock its respective side hand rail 46 in one of the above mentioned positions.

Figure 2:
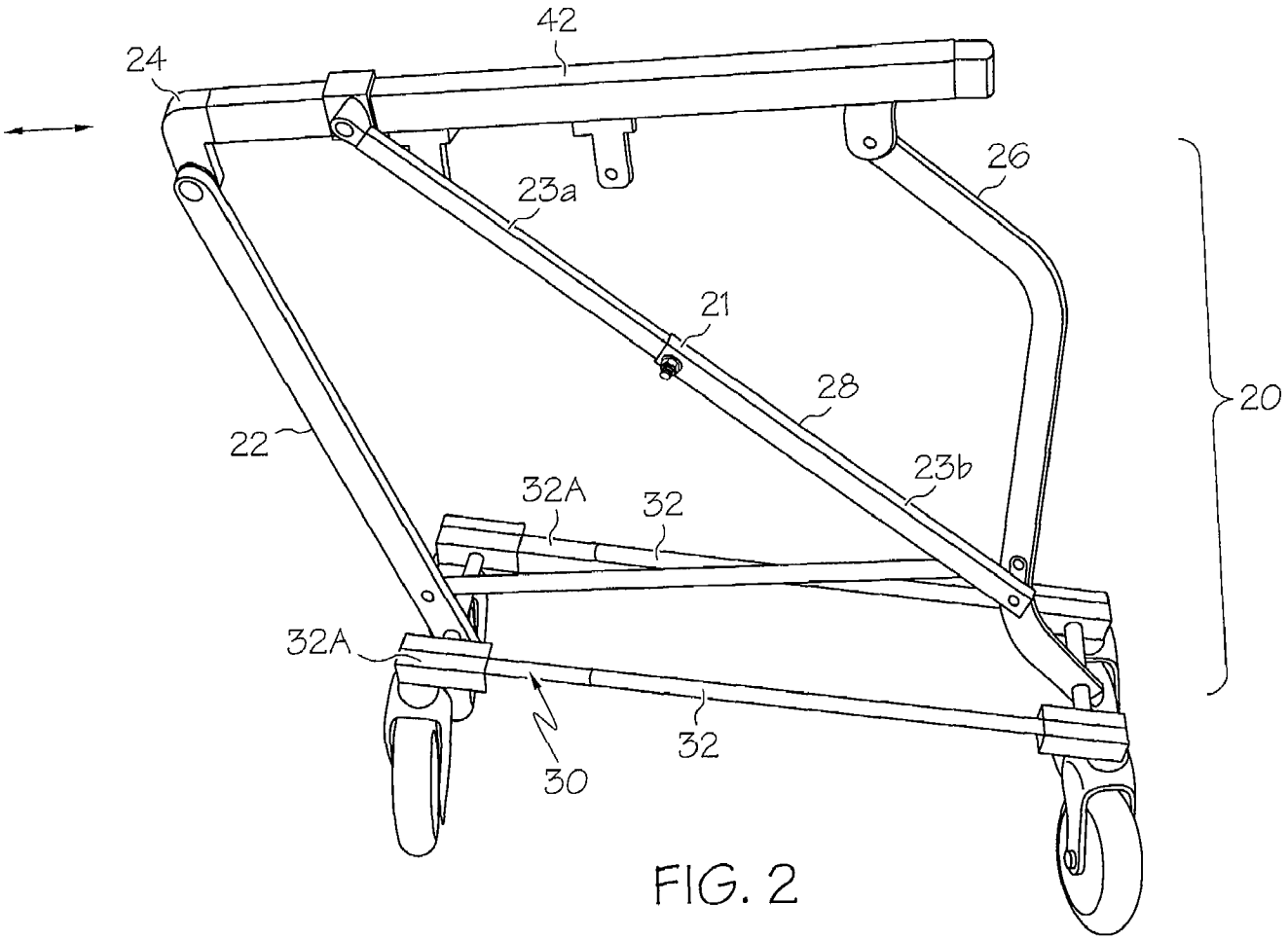
FIG. 2 is a side perspective view of one embodiment of a roll-in chair cot, with parts removed, to show the undercarriage thereof situated in the fully raised cot height position.
Figure 3A:
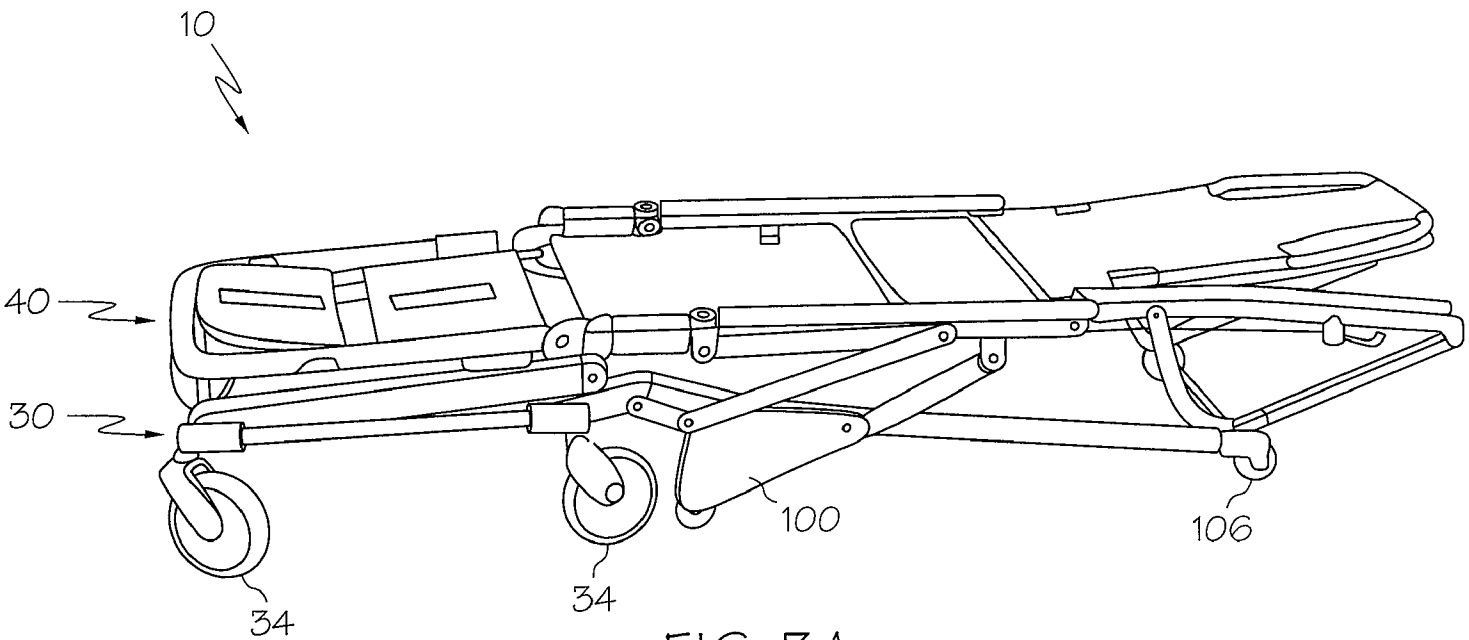
FIG. 3A is a side perspective view of one embodiment of a roll-in chair cot situated in a fully lowered cot height position.

Undercarriage 20 includes a first pair of fixed length legs 22 which are pivotally mounted to the support frame 40 and the roller base 30 such that the first pair of legs 22 may swing the roller base 30 generally parallel to the support frame 40. In particular, the first pair of fixed length legs 22 pivotably connect a front end of roller base 30 to a front telescoping end 24 of telescoping member 42, which is best shown in FIG. 2. A second pair of fixed length legs 26 is pivotably connected at a rear end of roller base 30 at one end and pivotable and slidably connect at the other opposed end to telescoping member 42. An optional combination bump guard and ground rolling wheel assembly 100 may be provided to each fixed length legs 26 as depicted in FIGS. 1B and 3A.

A pair of diagonally extending braces 28 is pivotally mounted to the support frame 40 and the roller base 30, in one embodiment as shown by FIGS. 1A and 1B, and in another embodiment as shown by FIG. 2, to a lower end of the second pair of fixed length legs 26 above its pivot connect to the roller base 30. The pair of diagonally extending braces 28 releasably support the legs 22 and 26 perpendicular to the roller base 30 and support frame 40 when the cot is positioned in the fully raised cot height position as illustrated in FIGS. 1A and 1B.

Figure 3B:
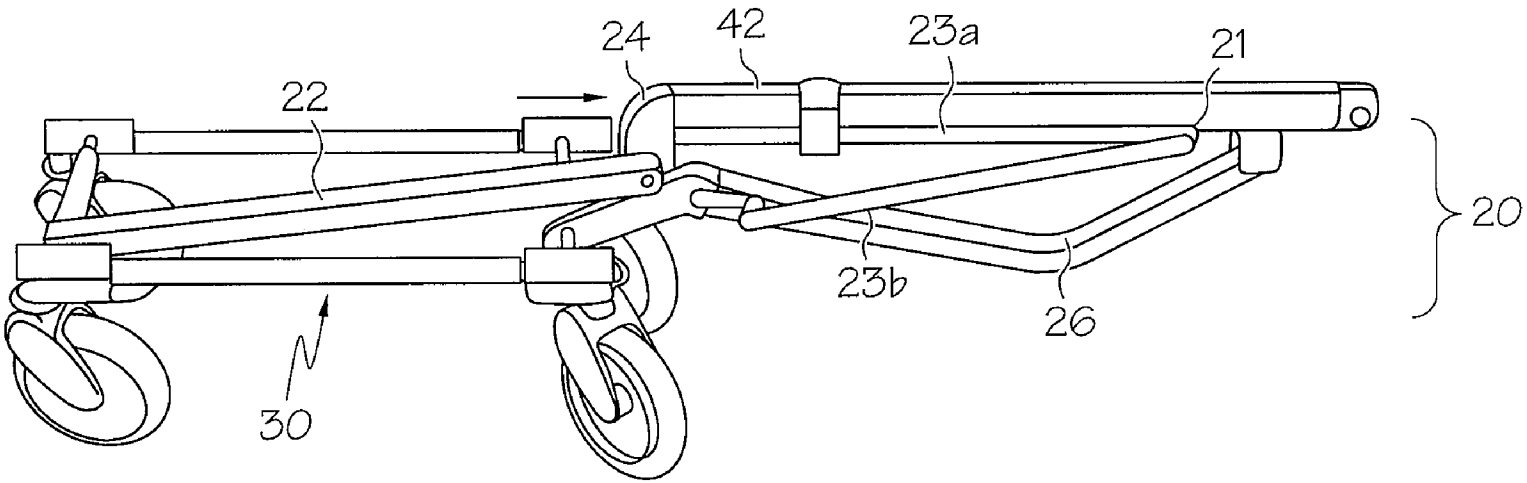
FIG. 3B is a side perspective view of the roll-in chair cot of FIG. 3A, with parts removed, to show the undercarriage thereof situated in a fully lowered cot height position.

As best shown by FIG. 2, each one of the pair of diagonally extending braces 28 have upper and lower links 23*a* and 23*b*, respectively, connected by a center hinge 21. Since each lower link 23*b* is pivotally mounted to either the roller base 30 or a respective one of the second pair of fixed length legs 26, and each upper link 23*a* is pivotally mounted to the support frame 40, breaking the center hinge 21 will permit the support frame 40 to collapse along with roller base 30 into a fully retracted cot height position which is best illustrated by FIG. 3A. In the fully retracted cot height or lowered position, the roller base 30, the wheel assembly 100, and loading wheels 106 support the cot 10 on the ground. FIG. 3B is a side perspective view of the roll-in chair cot of FIG. 3A, with parts removed, to show the undercarriage thereof situated in a fully lowered cot height position.

A conventional breaking mechanism (not shown) is used to facilitate the breaking or releasing of the braces 24 thereby permitting the roller base 30 to swing parallel to the support frame 40 into the fully retracted cot height position. One such conventional breaking mechanism is disclosed by commonly owned U.S. Pat. No. 3,289,219 to Ferneau et al., which is herein incorporated fully by reference.

Figure 4B:
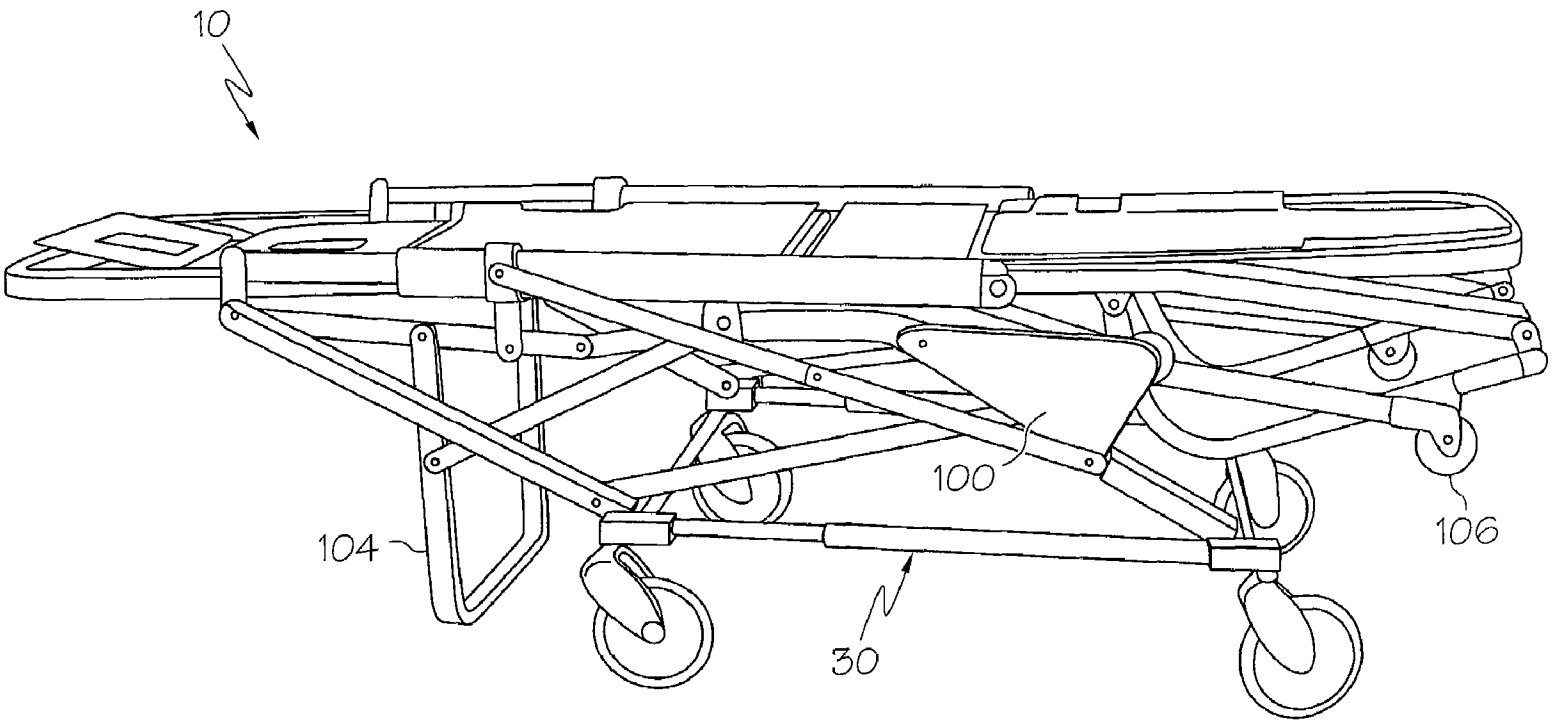

It is to be appreciated that the cot 10 is further positionable in an intermediate cot height position which locates the support frame 40 at approximately bed height such that a patient may be laterally transferred from the bed to the cot 10 in a generally supine position. This intermediate cot height position is best illustrated by FIG. 4A, with some part removed for convenience of illustration, and FIG. 4B showing a preferred embodiment.

Figure 5A:
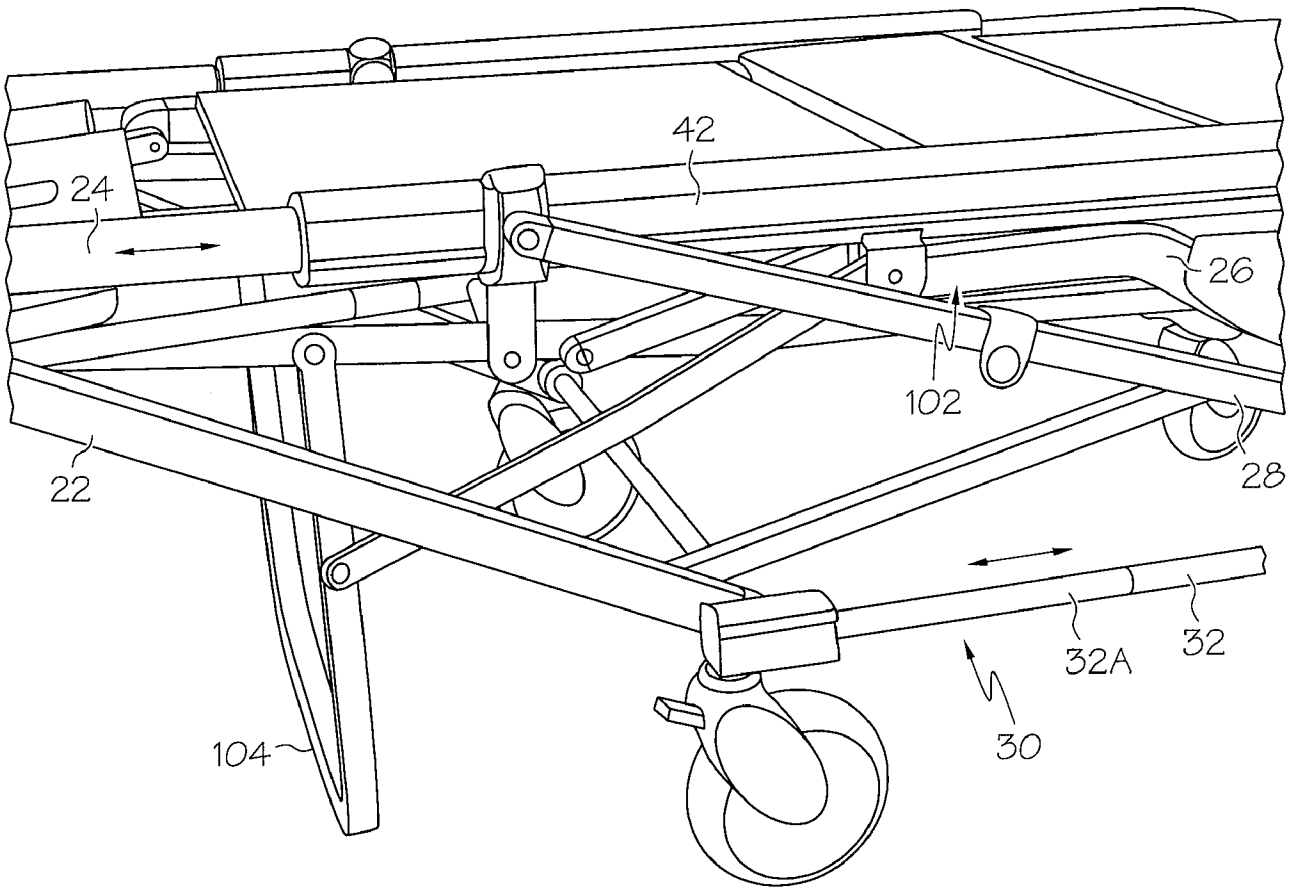
FIGS. 5A and 5B are side perspective views of one embodiment of a roll-in chair cot situated in an intermediate cot height position.
Figure 5B:
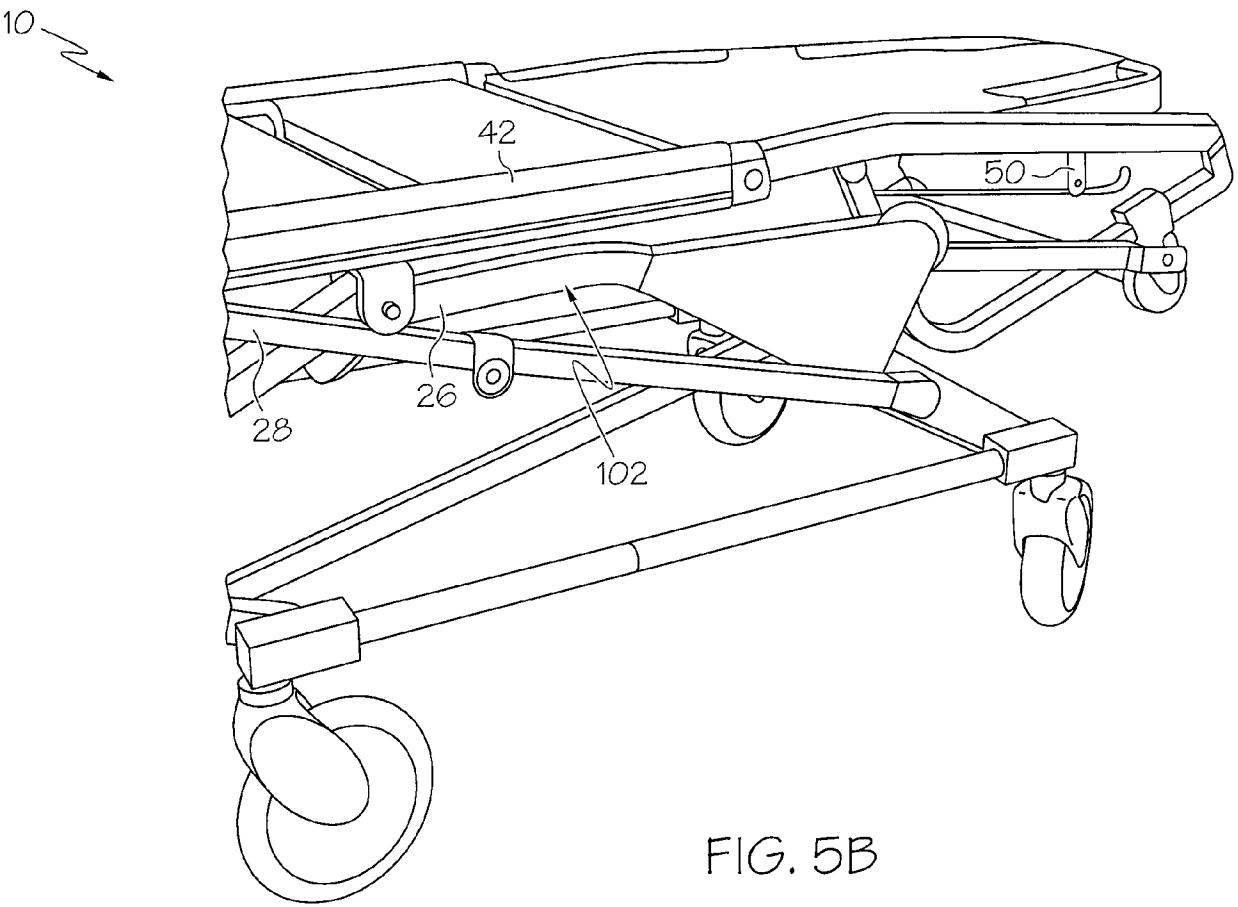
Figure 6:
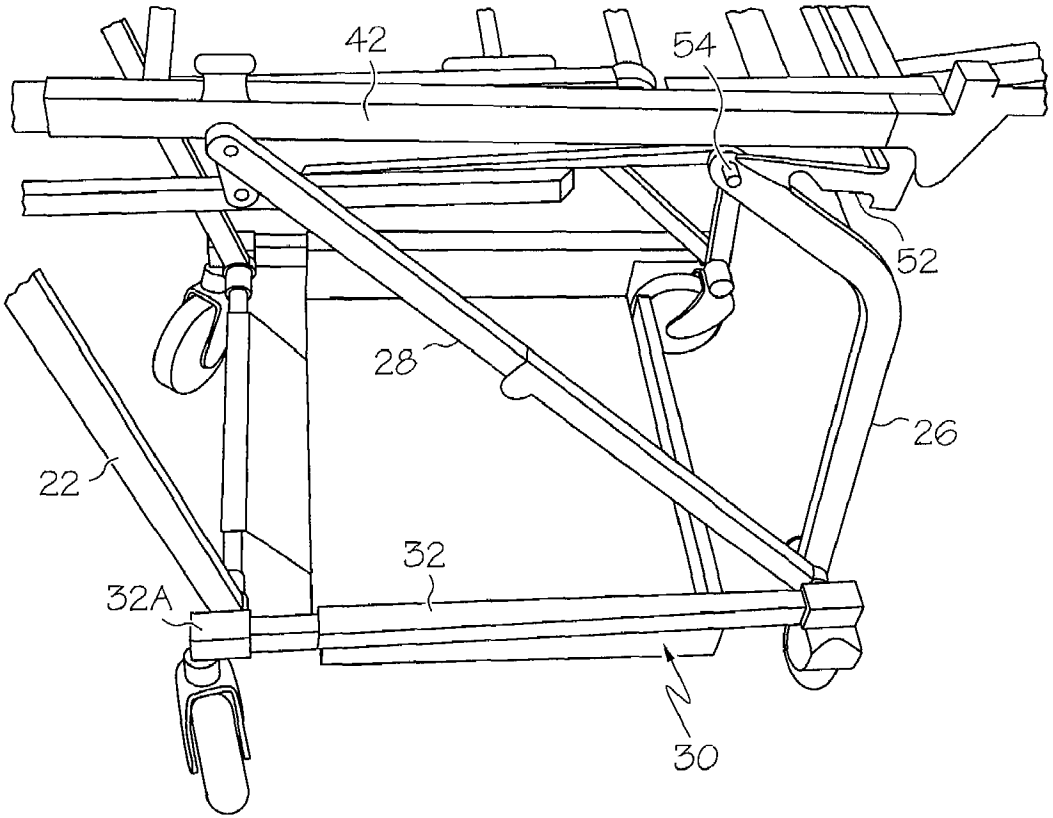
FIG. 6 is a close-up perspective view of a roll-in chair cot according to an embodiment of the present invention, showing the cot in a cot configuration located between the fully raised cot height position and an intermediate cot height position.
Figure 9:
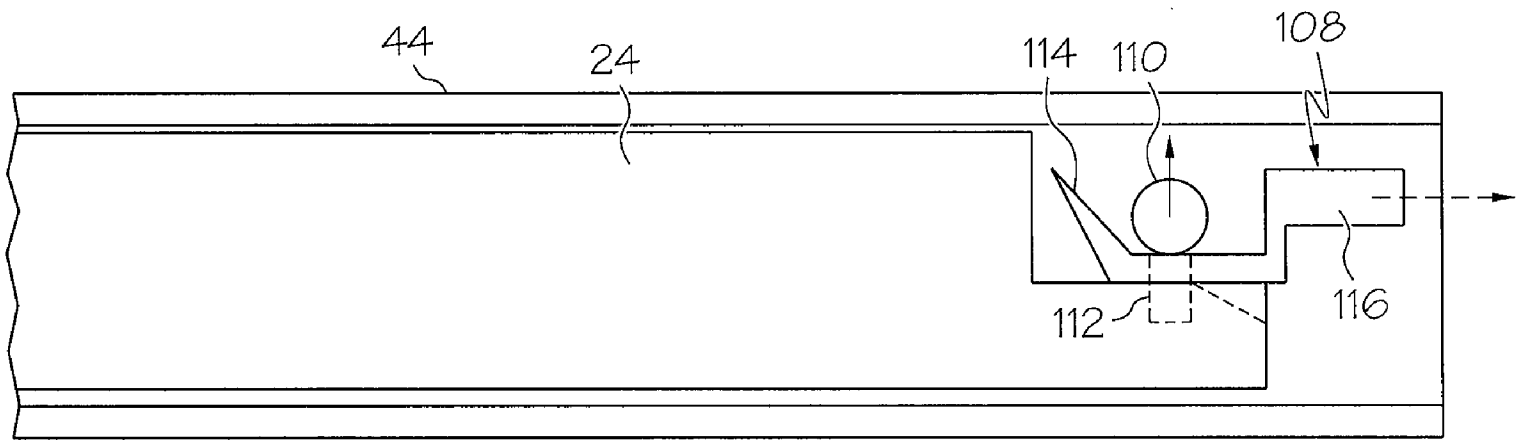
FIG. 9 is a close-up diagrammatic view of one embodiment of a locking pin assembly of an embodiment of a roll-in chair cot according to the present invention.

As best shown by FIGS. 5B and 6, a hand operated release mechanism 50 in one embodiment is operably connected to a pair of latches 52 each rotatably mounted to a respective one of the telescoping members 42. Each latch 52 releasably holds a respective pin 52 provided on the second pair of fixed length legs 26. Releasing the pins 54 from the latches 52 thereby permits the front telescoping end 24 of the telescoping members 42 to extend allowing the first pair of fixed length legs 22 to swing the support frame 40 parallel to the roller base 30 in the direction opposite from placing the cot 10 in the fully retracted cot height position. In another embodiment, the hand operated release mechanism is connected to an internal locking mechanism situated inside each telescoping members 42, having a latching pin arrangement 108 illustrated by FIG. 9. As illustrated, the latching pin arrangement 108 includes a ball pin 110 biased to a seated position within a cavity 112 provided near the enclosed end of the front telescoping end 24 to the telescoping member 42. Upon operating an actuator, a ramp portion 114 of a latch 116 will ride under the ball portion of the ball pin to unseat it from the cavity, thereby permitting the telescoping end 24 to freely slide within telescoping member 42. It is to be appreciated that the latch 116 is also biased to the locking position illustrated.

Figure 5C:
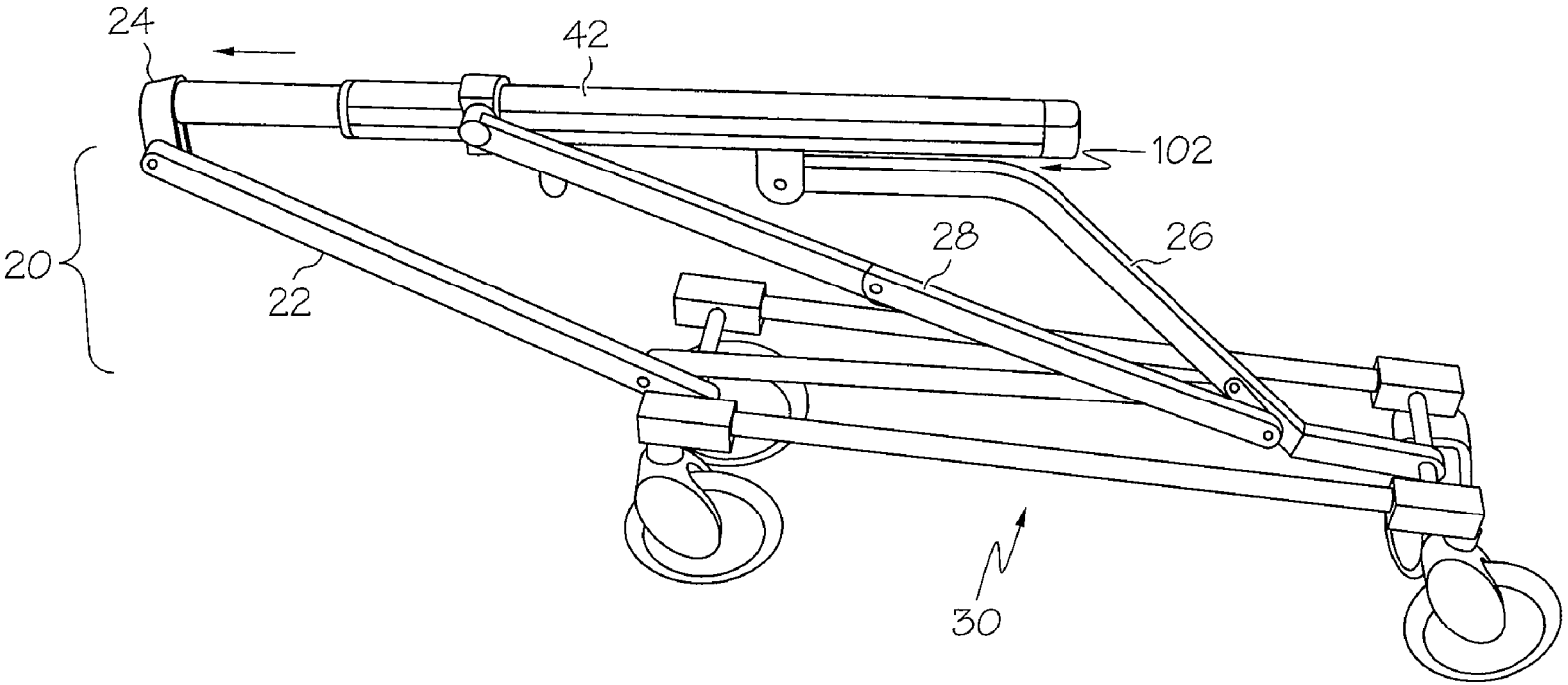
FIG. 5C is a side perspective view of the roll-in chair cot of FIG. 5A, with parts removed, to show the undercarriage thereof situated in an intermediate cot height position.

As the support frame 40 swings relative to the roller base 30, the telescoping member 42 will come to rest on a shoulder portion 102 of the second pair of fixed length legs 26 thereby placing the cot 10 in the intermediate position, which is best shown by FIGS. 5A and 5C. A landing brace 104 automatically folds down from a stowed position illustrated by FIG. 3A to a deployed position as shown in FIG. 5A. The landing brace 104 provides additional stability to the cot when located in the intermediate position, such that the cot does not teeter. It is to be appreciated that transitioning the cot 10 in the opposite direction from the intermediate cot height position, will rotate the legs 22, 26 and cross braces 28 until the latch 52 once again releasably holds the pins 54, thereby securing the cot 10 once again in the fully extended cot height position illustrated by FIG. 1. The latch 52 and pin 54 is best shown in FIG. 6.

Figure 7:
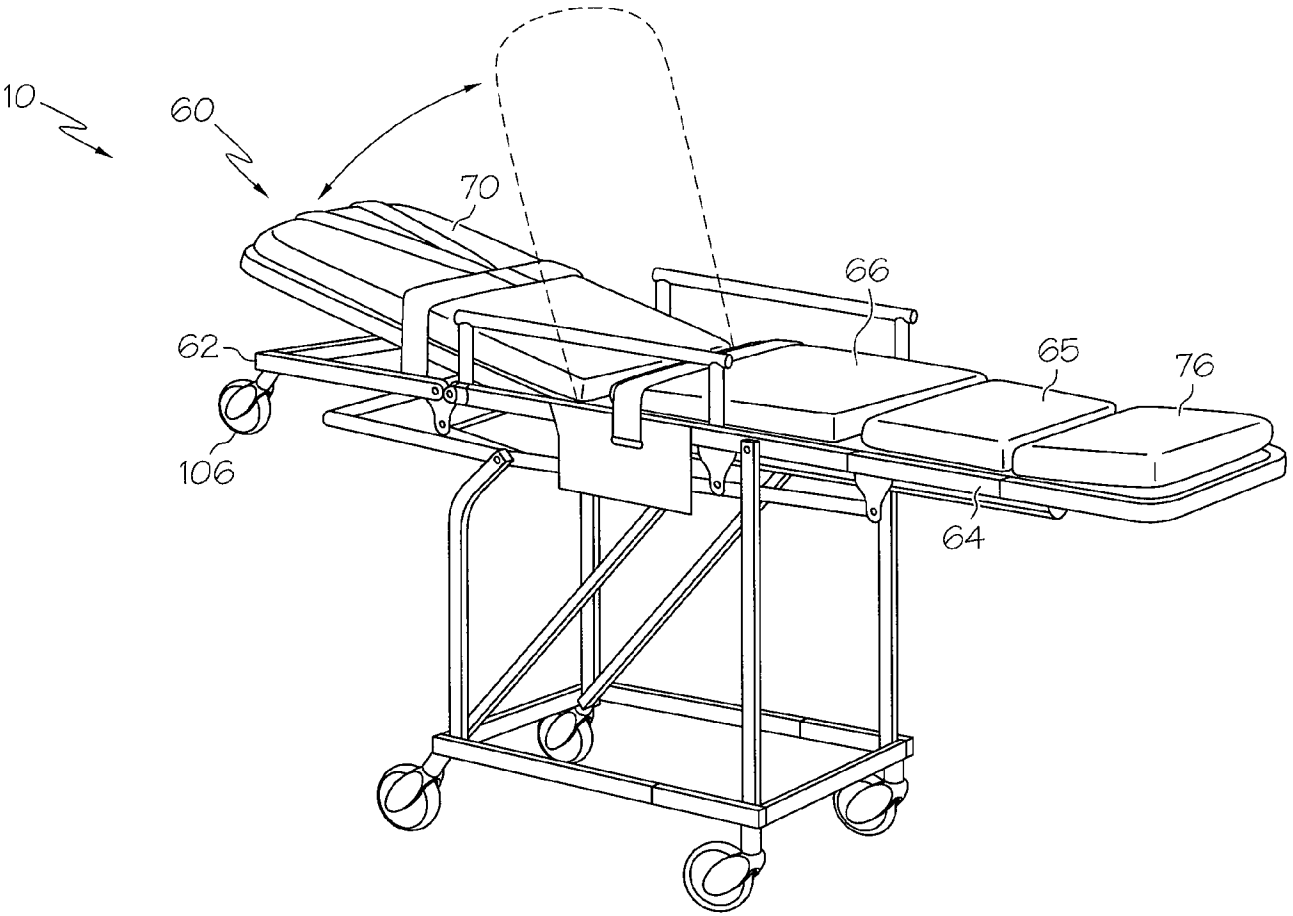
FIG. 7 is a perspective view of a roll-in chair cot according to an embodiment of the present invention, showing the cot in a cot configuration located at a fully raised cot height position.
Figure 8A:
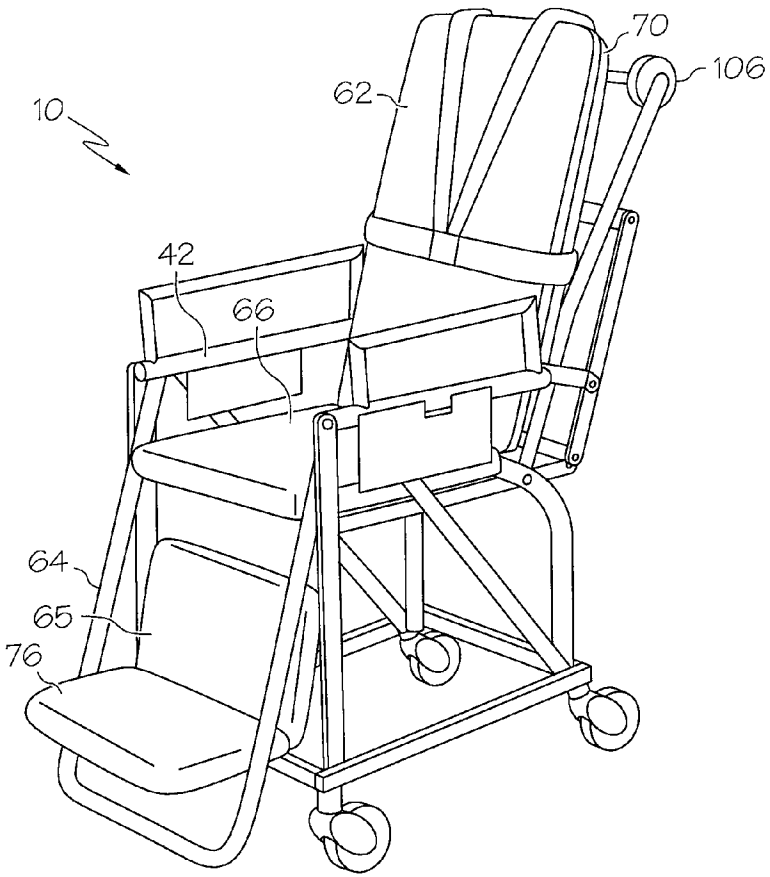
FIGS. 8A, 8B, and 8C are perspective views of a roll-in chair cot according to an embodiment of the present invention, showing the cot in a chair configuration.
Figure 8B:
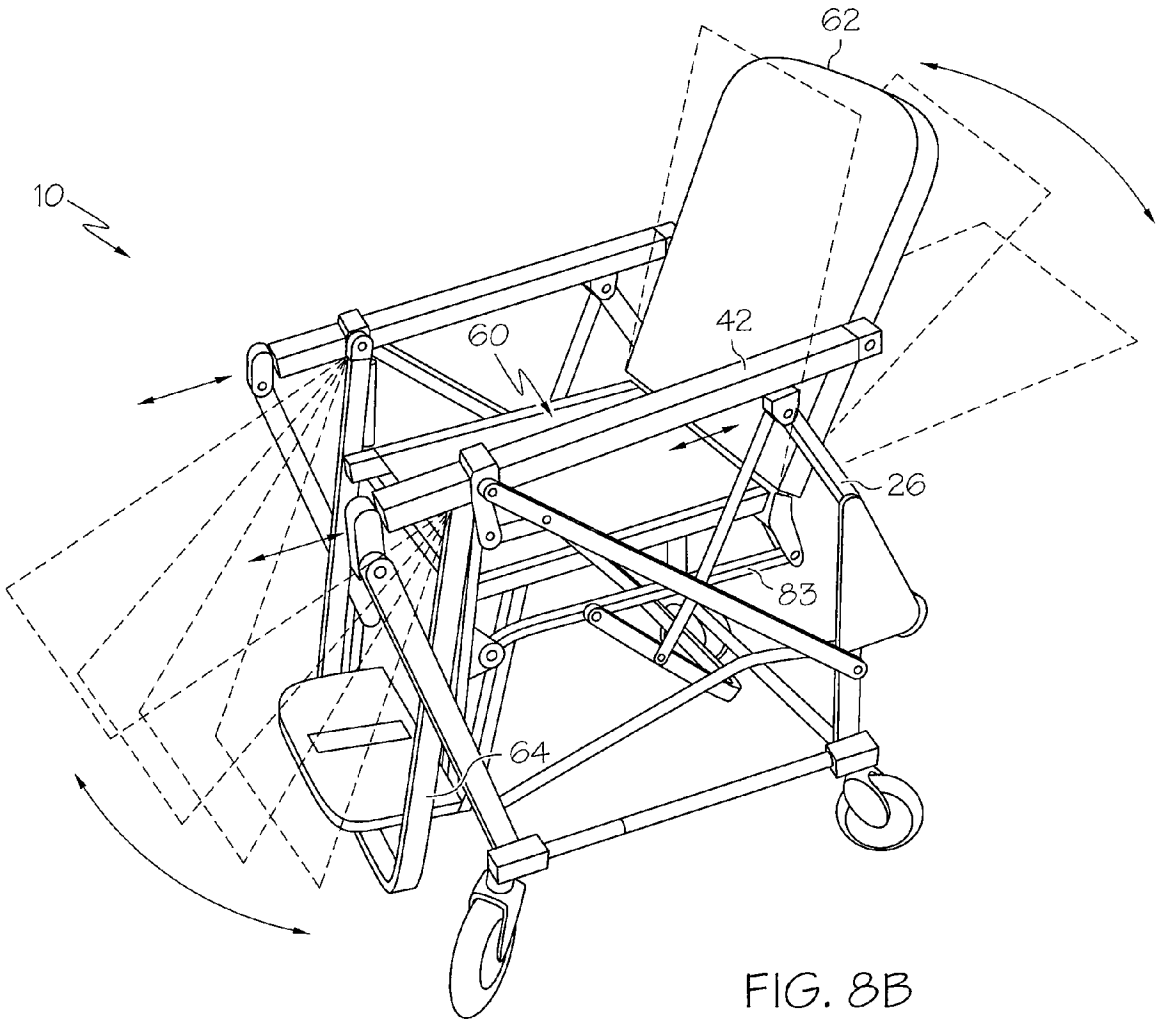
Figure 8C:
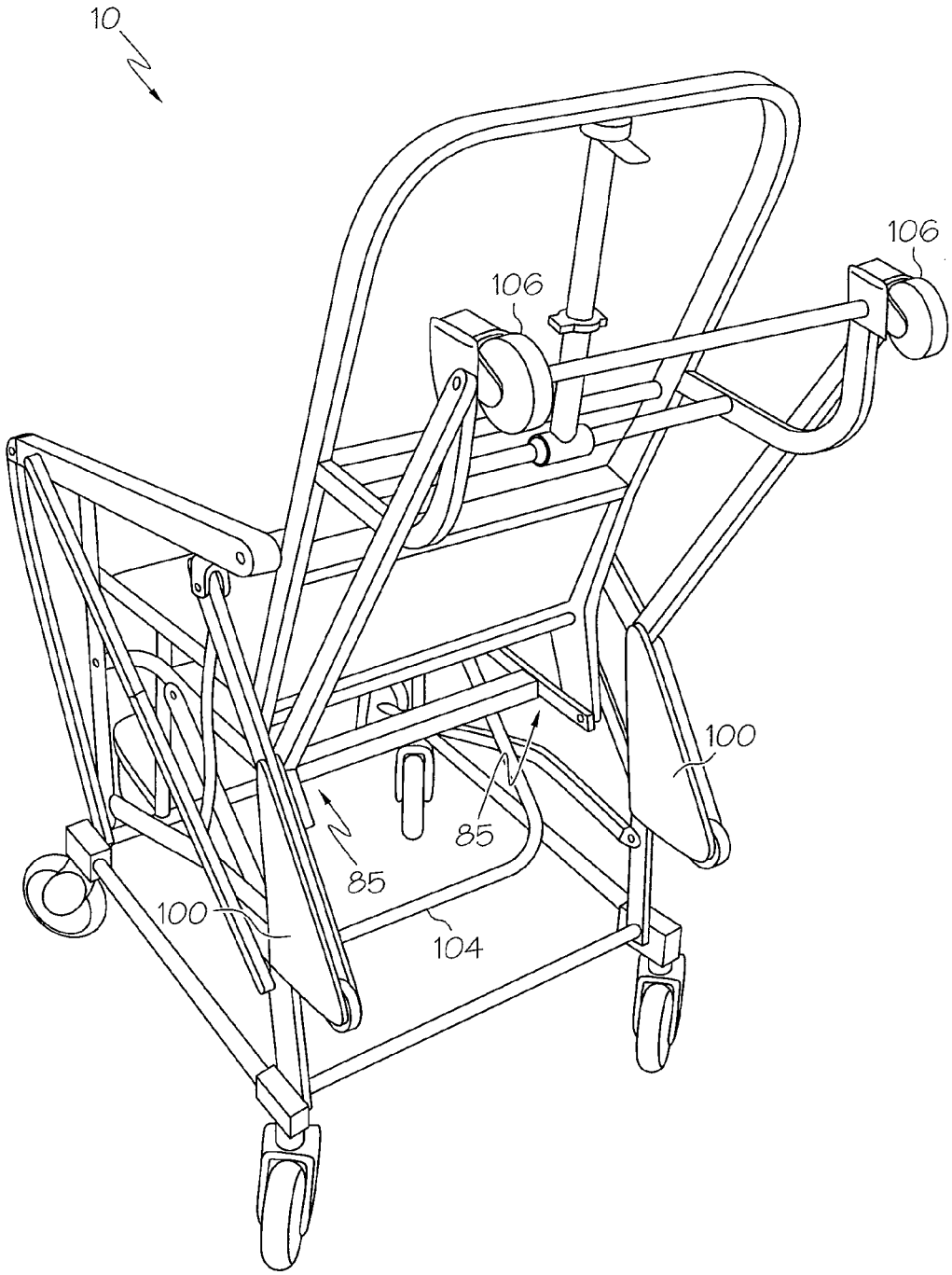

Cot 10 further includes an articulated bed frame, generally indicated by 60, which is adjustable between a cot configuration, such as shown in FIG. 7 with the cot in the fully elevated position, and a chair configuration, such as shown in FIGS. 8A, 8B, and 8C. Bed frame 60 comprises three main segments namely, a wheeled back segment 62, a leg segment 64 and a seat segment 66 operably connected to each other between the pair of telescoping members 42. Back segment 62 is pivotably connected to one of the cross members 44. As such, with the back segment 62, the leg segment 64, seat segment 66 operably connected to each other in this fashion, when the cot 10 is in the chair position, the seat segment 66 is generally horizontal and both the back segment 62 and the leg segment 64 are generally vertical relative to the base 30 as illustrated by FIG. 8A. The pair of loading wheels 106 are affixed to a free end of the support frame 40, best shown by FIG. 8C, thereby defining a loading end of the cot 10 thereof. The front loading wheels 106 may be adjusted to allow for additional height as explained hereafter.

Figure 10:
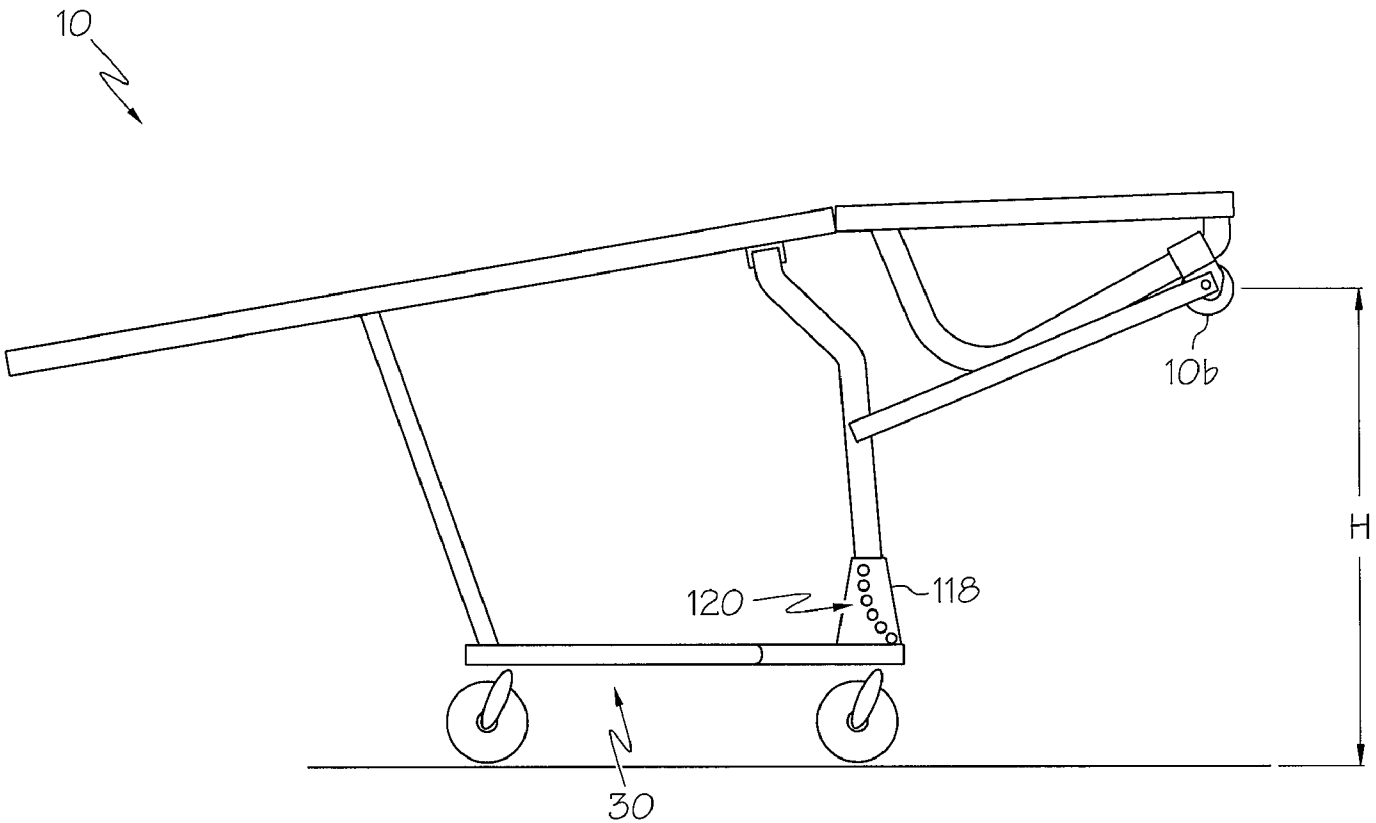
FIG. 10 is a diagrammatic view of another embodiment, with parts not illustrated, of a roll-in chair cot according to the present invention.

It is to be appreciated that in another embodiment, such as illustrated by FIG. 10, the fixed length legs 26 may be releasably mounted to the wheeled base 30 via bracket 118 having a bolting pattern 120. The bolting pattern 120 permits the height H of the loading wheels 106 to be adjustable. In one embodiment, the bolting pattern 120 permits adjusting the loading wheels 106 between a height H ranging from about 24" to about 34". It is to be appreciated that member pairs 32, 32A telescope when the cot is transitioned from a lower position to an elevated loading position as depicted in FIG. 10, such that the center of gravity between the points of contact is kept on the ground such that the cot 10 does not tip.

Referring back to FIG. 8A, the back segment 62 further includes a frame like backrest member 70 that is pivotably mounted between the frame of the back segment 62 to one of the cross members 44. A first extending member or biasing spring 72 (FIG. 1A) is connected at a first end to backrest member 70 adjacent a free end thereof, and at a second end to a cross member 74. Biasing spring 72 provides a positive, tensile biasing force when activated. Lock release 84 is connected to backrest member 70 such that, depressing release 84 releases the locking mechanism within biasing spring 72, thereby causing backrest member to pivot about the respective cross member 44 into an upright position from 0° to 90° or any position therebetween, such as illustrated by FIG. 7, under the influence of the biasing force of the spring.

As illustrated by FIGS. 8A, 8B, and 8C, the leg segment 64 connects at an upper end thereof to front ends of the pair of the telescoping members 42. A foot support panel 76 is pivotably connected to the leg segment 64. The foot support panel 76 may be elevated to provide a footrest to a reclined patient. In the cot position, the foot support panel 76 is normally stowed such as illustrated in FIG. 7. As best shown by FIG. 8B, the bed frame 60 may be situated in the chair configuration of FIG. 8A, a cot configuration of FIG. 1B, and a number of reclined positions therebetween. In one embodiment, transitioning the back segment 62 from the chair position to a reclined position, will also transition the leg segment 64 to the associated reclined position due to these segments being linked by push arm 83.

Seat segment 66 is positioned between the pair of telescoping members 42 and is pivotably connected at a rear end thereof. A front end of the seat segment 66 is connected to a rear end of the foot support panel 76 of the leg segment 62 by a leg support panel 65, which is pivotably connected at a first end thereof to the seat segment 66 and which is pivotably connected at a second end thereof to the rear end of the foot support panel 76.

In one embodiment, a pair of lift biasing springs 85 are each pivotably connected between the seat frame and the back frame. In other embodiment, a single lift biasing spring or cylinder may be used. The pair of lift biasing springs 85 is constructed in a similar fashion as biasing spring 84 described above. It is to be appreciated that using the pair of lift biasing springs 85 reduces weight and allow infinite adjustment between the leg, seat, and back frames of the cot 10 to the chair configuration of FIG. 8A, a cot configuration of FIG. 1B, and a number of reclined positions therebetween, which allows a patient to find a chair angle that provides the most comfortable position.

Pillows, pads or cushions or a full length mattress as shown in FIGS. 7 and 8 may be secured to support frame 40 to provide a comfortable resting place upon which the patient is situated. Additionally, the cot may be provided with a number of restraints as is customary in the art.

As described above, the roll-in chair cot of the present invention is movable between three cot height positions: a fully lowered position, a fully elevated position, and an intermediate position locating the cot at approximately bed height such that a patient may be laterally transferred from the bed to the cot in a generally supine position. Additionally, the roll-in chair cot readily converts from a level cot to a contoured chair for maneuvering ease in narrow hallways, elevators, and other confined spaces. The roll-in cot has folding legs for simple loading and unloading by two emergency medical technicians (EMTs) into the back of an emergency vehicle. Spring-actuated, folding legs minimize the lifting effort required by the EMTs. Additionally, the supporting legs automatically lock into place when the undercarriage is fully unfolded. In one embodiment, rectangular, tubular aluminum construction provides durability and strength. In another embodiment, plastic bearings are provided on rotating components for easy movement. In still other embodiment, the wheels are greaseless wheels. In another embodiment, the cot provides an adjustable backrest angle from 0° to 75° which allows a patient to be placed in a comfortable position during transport. Patient restraint system ensures safety of patient during transport, and in one embodiment comprises two across patient restraints and one shoulder harness. In another embodiment, a full-length, sectional mattress provides comfort and folds with the cot as it is moved into the chair position. Swing-down side hand rails enable convenient patient transfer from hospital bed to cot.

Although the present invention has been described in terms of a specific embodiment which is set forth in detail, it should be understood that this is by illustration only and that the present invention is not necessarily limited thereto, since alternative embodiments not described in detail herein will become apparent to those skilled in the art in view of the above description, the attached drawings and the appended claims. Accordingly, modifications are contemplated which can be made without departing from either the spirit or the scope of the present invention.

What is claimed is:

1. A roll-in chair cot for transporting a patient, said roll-in chair cot comprising:

a patient support surface configured to be movable between a chair position, a fully lowered position, a fully elevated cot height position, and an intermediate cot height position between said fully lowered cot height position and said fully elevated cot height position, said patient support in each of said fully lowered cot height position, a fully elevated cot height position, and an intermediate cot height position is configured to permit said patient to be transported thereon in a generally supine position, and said patient support in the chair position arranges the chair cot such that relative to a seat segment both a leg segment extends downwardly and a back segment extends upwardly, thereby permitting the patient to be transported thereon in a generally seated position; and a bolting pattern provided to said roll-in cot, said bolting pattern configured to permit adjusting a loading height of said roll-in cot.

2. The roll-in chair cot as recited by claim 1, further comprising a support frame providing said patient support surface.

3. The roll-in chair cot as recited by claim 1, further comprising a support frame providing said patient support surface; and a roller base providing the bolt pattern.

4. The roll-in chair cot as recited by claim 1, further comprising:

a support frame providing said patient support surface;

a roller base; and legs pivotably connected between said support frame and roller base.

5. The roll-in chair cot as recited by claim 1, further comprising a support frame providing said patient support surface, wherein said patient support surface is an articulated bed frame pivotally mounted to said support frame for movement at least between a chair configuration and a cot configuration.

6. The roll-in chair cot as recited by claim 1, further comprising a support frame providing said patient support surface, wherein said patient support surface is an articulated bed frame pivotally mounted to said support frame for movement at least between a chair configuration, a cot configuration, and a reclined position.

7. The roll-in chair cot as recited by claim 1, further comprising a support frame providing said patient support surface, wherein said patient support surface is an articulated bed frame having the back segment and the leg segment each pivotally mounted to said support frame, wherein said bed frame is configured for movement at least between a chair configuration, a cot configuration, and a reclined position, wherein transitioning said back segment from the chair position to the reclined position also transitions said leg segment to the reclined position.

8. The roll-in chair cot as recited by claim 1, further comprising:

a support frame providing said patient support surface, wherein said patient support surface is an articulated bed frame having the back segment and the leg segment each pivotally mounted to said support frame; and a push arm pivotably connected between said leg segment and said back segment.

9. The roll-in chair cot as recited by claim 1, further comprising:

a support frame providing said patient support surface;

a roller base; and a diagonal brace pivotally mounted to between said support frame and said roller base.

10. The roll-in chair cot as recited by claim 1, further comprising:

a support frame providing said patient support surface;

a roller base; and legs pivotably connected between said support frame and said roller base, said legs are configured to swing said roller base generally parallel to said support frame from said fully elevated cot height position to said intermediate cot height position in a first direction, and from said fully elevated cot height position to said fully lowered position in a second direction opposite to said first direction.

11. The roll-in chair cot as recited by claim 1, further comprising:

a support frame providing said patient support surface and having a pair of spaced apart telescoping members;

a roller base providing said bolt pattern; and first and second pairs of legs, each one of said first pair of legs is mounted pivotally to a respective one of said pair of spaced apart telescoping members and said roller base, and each one of said second pair of legs is mounted pivotably between said support frame and said roller base, said first and second pairs of legs are configured to swing said roller base generally parallel to said support frame from said fully elevated cot height position to said intermediate cot height position in a first direction, and from said fully elevated cot height position to said fully lowered position in a second direction opposite to said first direction.

12. A roll-in chair cot comprising:

a support frame having a pair of telescoping members spaced apart by a plurality of cross-members;

a roller base;

an articulated bed frame pivotally mounted to said support frame for movement at least between a chair configuration and a cot configuration;

first and second pairs of legs, each one of said first pair of legs pivotally mounted to respective telescoping ends of said telescoping members and said roller base, each one of said second pair of legs pivotally mounted to said telescoping members and said roller base, such that said legs are configured to swing said roller base generally parallel to said support frame from a fully elevated cot height position to an intermediate cot height position in a first direction, and from the fully elevated cot height position to a fully lowered position in a second direction opposite to said first direction, and vice-versa;

at least one diagonal brace pivotally mounted to between said support frame and said roller base, said diagonal brace being configured to fold when said cot is placed in said fully lowered position;

loading wheels provided to said support frame; and a bolting pattern provided to said roller base, said bolting pattern configured to permit adjusting a loading height of said loading wheels, said loading height ranges from about 24" to about 34".

13. A roll-in chair cot for transporting a patient, said roll-in cot comprising:

a patient support surface configured to be movable between a chair position, a fully lowered cot height position, a fully elevated cot height position, and an intermediate cot height position between said fully lowered cot height position and said fully elevated cot height position, said chair position providing said patient support in a manner such that relative to a seat segment both a leg segment extends downwardly and a back segment extends upwardly, thereby permitting the patient to be transported upon the chair cot in a generally seated position, and each of said cot height positions providing said patient support in a manner to at least permit the patient to be transported upon said chair cot in a generally supine position, wherein said cot transitions from said fully elevated cot height position to said intermediate cot height position in a first direction, and from said fully elevated cot height position to said fully lowered position in a second direction opposite to said first direction; and a bolting pattern provided to said roll-in cot, said bolting pattern configured to permit adjusting a loading height of said roll-in cot.

14. The roll-in chair cot as recited by claim 13, further comprising:

a roller base supporting said support frame; and legs pivotably connected between said support frame and roller base.

15. The roll-in chair cot as recited by claim 13, further comprising a support frame providing said patient support surface, wherein said patient support surface is an articulated bed frame pivotally mounted to said support frame for movement at least between a chair configuration and a cot configuration.

16. The roll-in chair cot as recited by claim 13, further comprising a support frame providing said patient support surface, wherein said patient support surface is an articulated bed frame pivotally mounted to said support frame for movement at least between a chair configuration, a cot configuration, and a reclined position.

17. The roll-in chair cot as recited by claim 13, further comprising a support frame providing said patient support surface, wherein said patient support surface is an articulated bed frame having the back segment and the leg segment each pivotally mounted to said support frame, wherein said bed frame is configured for movement at least between a chair configuration, a cot configuration, and a reclined position, wherein transitioning said back segment from the chair position to the reclined position also transitions said leg segment to the reclined position.

18. The roll-in chair cot as recited by claim 13, further comprising:

a support frame providing said patient support surface;

a roller base providing the bolting pattern and supporting said support frame; and a diagonal brace pivotally mounted to between said support frame and said roller base.

* * * * *

UNITED STATES PATENT AND TRADEMARK OFFICE

CERTIFICATE OF CORRECTION

PATENT NO. : 7,581,265 B1
APPLICATION NO. : 11/444238
DATED : September 1, 2009
INVENTOR(S) : Bourgraf et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 250 days.

Signed and Sealed this

Fourteenth Day of September, 2010

David J. Kappos

David J. Kappos
*Director of the United States Patent and Trademark Office*